US005599216A

United States Patent [19]

Reightley

[11] Patent Number: 5,599,216

[45] Date of Patent: Feb. 4, 1997

[54] METHOD AND APPARATUS FOR STOWING AND UNSTOWING AN ENGINE IN A DINGHY

[76] Inventor: Donald R. Reightley, 8408 SE 53rd Pl., Mercer Island, Wash. 98040

[21] Appl. No.: 554,872

[22] Filed: Nov. 7, 1995

Related U.S. Application Data

[63] Continuation of Ser. No. 242,140, May 13, 1994, abandoned.

[51] Int. Cl.[6] ..... B63H 20/08

[52] U.S. Cl. ..... 440/53; 248/642

[58] Field of Search ..... 114/62, 365, 366; 440/53, 55, 62, 63; 248/640, 642

[56] References Cited

U.S. PATENT DOCUMENTS

| | | | |
|---|---|---|---|
| 2,119,281 | 5/1938 | Luders, Jr. | 440/53 |
| 2,901,194 | 8/1959 | Shontz | 248/642 |
| 2,945,466 | 7/1960 | Shelton | 114/62 |
| 3,216,388 | 11/1965 | Smith | 114/365 |
| 3,274,849 | 9/1966 | Hanson | 440/53 |
| 3,348,794 | 10/1967 | Hayes | 440/63 X |
| 3,511,208 | 5/1970 | Woodruff | 440/62 |
| 4,025,010 | 5/1977 | Soot | 440/53 X |
| 4,157,596 | 6/1979 | Green | 114/365 |

OTHER PUBLICATIONS

"West Marine", 1992 Master Catalog, p. 318 1992.
"Nautical Terms", Charles F. Chapman, p. 27 1972.

*Primary Examiner*—Sherman Basinger
*Attorney, Agent, or Firm*—Robert M. Storwick

[57] ABSTRACT

A method and apparatus for stowing and unstowing an engine in a dinghy. The apparatus includes a bracket to which the engine is attached. The bracket is pivotally attached to the transom of the dinghy through a transfer plate having two substantially perpendicular horizontal pivotal axes. As installed in the dinghy, the pivotal axes are substantially horizontal when the engine is in its operative position over the dinghy transom. To stow the engine, a handle on the bracket is lifted about a first of the two pivotal axes until the engine clears the transom. The bracket is then pivoted forward about its second pivotal axis until the bracket can be attached to a surface in the dinghy. The engine is thereby stowed in a first storage attitude. The entire dinghy, with stowed engine, can then be stowed out of the water on a second boat by rotating the dinghy about an axis that is parallel to the dinghy's longitudinal axis. This stows the engine in a second storage attitude, safely within the hull of the dinghy and against the hull of the second boat.

14 Claims, 6 Drawing Sheets

METHOD AND APPARATUS FOR STOWING AND UNSTOWING AN ENGINE IN A DINGHY

This application is continuation of application Ser. No. 08/242,140, filed May 13, 1994, and now abandoned the benefit of the filing dates of which are hereby claimed under 35 USC 120.

TECHNICAL FIELD

The present invention relates to methods and apparatus for use in dinghies, and more particularly, to methods and apparatus for stowing and unstowing a dinghy attachment into and from the dinghy.

BACKGROUND OF THE INVENTION

Marine vehicles, such as power boats, typically travel with a dinghy. Such dinghies are useful for various purposes, such as possible rescue service, ferry service to and from shore or another boat, or water recreation.

Smaller dinghies are often manually powered, typically by means of oars. In contrast, larger dinghies carry generally outboard engines, and some dinghies, particularly those used for fishing, carry outboard electric motors for trolling. Such engines and motors usually mount to motor mounts that are typically part of the dinghies' hulls.

Dinghies can be towed left floating free from their mother boat and towed from place to place as necessary. (For long distance travel, dinghies are generally brought aboard or otherwise secured to their mother boat, above and away from the water.) However, unless properly secured, free-floating dinghies tend to rub against and have low velocity collisions with their mother boat. In addition, free-floating dinghies accumulate scum and other dirt from the water and atmosphere. Most significantly, free-floating dinghies that are left unattended are subject to vandalism and theft, including theft of their expensive on-board equipment, such as engines and motors, as well as related equipment, such as fuel tanks and batteries.

One of the primary reasons that dinghies are left free-floating is that hoisting them aboard their mother boat can be difficult. While the use of davits and power-assisted systems have taken away much of the manual labor from the job of hoisting a dinghy aboard, the separate stowage of even just a dinghy engine or motor can be difficult for two or three people. The reason is that such engines or motors can be relatively heavy and cumbersome and their removal and handoff to individual(s) aboard the mother boat can be precarious. Accordingly, in some present-day dinghy stowage systems, the dinghy is stowed with the engine still associated with the dinghy. In such systems, it is important to stow a fuel-powered engine in a proper stowage attitude. One such attitude is with the power shaft of the engine vertical, which is approximately the same attitude that it has when running, in order to avoid spillage or seepage of the fuel or engine lubricants. Another acceptable engine stowage attitude is with the engine shaft approximately horizontal and the propeller pointed upward.

Quite complicated mechanisms are necessary to assure the proper stowage of a still-attached dinghy engine while stowing the dinghy. One example of such a system is shown in U.S. Pat. No. 4,157,596, in which the dinghy engine is maintained in a space between the stowed dinghy hull and the rear transom of the mother boat. Another example of such a system is a motor mount that includes two or more concentric circular cylinders extending perpendicularly outward from the dinghy transom and having a motor attachment at the end. In this system, the relative positions of the cylinders are maintained by use of a through pin, to prevent the cylinders from rotating relative to one another when undesirable. However, when a dinghy is stowed against a mother boat, one of the cylinders is rotated through an approximate angle of ninety degrees so that the motor is held on the dinghy transom, in its operative attitude relative to the water. Generally, while such stowage systems stow the dinghy engine or motor in the proper attitude, the engine or motor is still subject to vandalism or theft because it is on prominent display.

Accordingly, it is desirable to have a method and apparatus for dinghy engine or motor stowage that is easy to use while stowing the engine or motor in a stowage configuration within the dinghy and also allows the dinghy with stowed engine or motor to be stowed adjacent a mother boat while simultaneously providing theft and vandalism protection to the engine or motor.

SUMMARY OF THE INVENTION

According to one aspect, the invention is method for stowing an attachment connected to a boat hull. The attachment has a substantially horizontal first axis and a substantially horizontal second axis. The substantially horizontal second axis is substantially perpendicular to the first axis and fixed relative to the hull. First portions of the attachment extend outboard of and below the hull when the attachment is in a deployed position. The method includes the steps of a) rotating the attachment about the first axis until the attachment is above the hull, and b) rotating the attachment about the second axis and into the hull so that the first portions of the attachment are stowed within the hull in a stowed position.

According to another aspect, the invention is an apparatus for stowing an attachment connected to a boat hull. The attachment has a substantially horizontal first axis and a substantially horizontal second axis substantially perpendicular to the first axis. The second axis is fixed relative to the hull. First portions of the attachment extend outboard of and below the hull when the attachment is in a deployed position. The apparatus includes a first rotation pivot in the attachment to rotate the attachment about the first axis until attachment is above the hull, and a second rotation pivot in the attachment to rotate the attachment about the second axis and into the hull so that the first portions of the attachment are stowed within the hull in a stowed position.

DETAILED DESCRIPTION OF THE INVENTION

Figure 1:
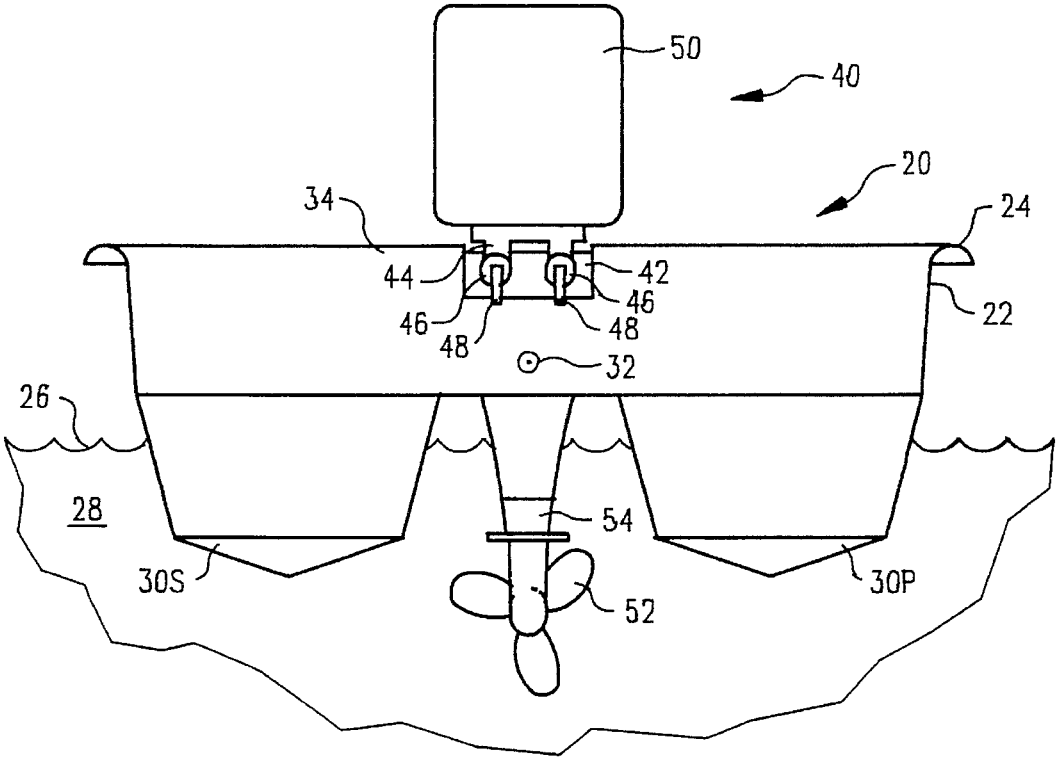
FIG. 1 PRIOR ART
FIG. 1 is an aftward transverse cross-section view of a dinghy with an engine installed according to a method known in the prior art.

FIG. 1 is an aftward transverse cross-section view of a dinghy with an engine installed according to a method known in the prior art. The dinghy 20 has a hull 22 with a gunwale 24 that is uppermost on the hull 22 when the hull 22 is in its service position, such as floating on the surface 26 of a body of water 28. In this particular example, the dinghy 20 includes twin hulls 30P and 30S, which are respectively the port and starboard hulls. The dinghy 20 also has a longitudinal axis 32, which runs fore and aft along the plane of symmetry of the hull 22. (In FIG. 1, the longitudinal axis 32 is perpendicular to the plane of the drawing sheet.) The hull 22, which is concave, has an aftward transom 34, which is a planar member that is substantially perpendicular to the longitudinal axis 32.

An outboard engine 40 is attached to the transom 34 of the hull 22 of the dinghy 20 at the location of an engine mount 42 which is either a part of or attached to the transom 34. The outboard engine 40 hangs over the aft side of the transom 34 and into the body of water 28. The outboard engine 40 includes a mounting bracket 44 which includes two or more clamps 46, each including a handle 48 that is used to tighten the clamp 46 against the engine mount 42. The outboard engine 40 has a power unit 50 which provides the power to a propeller 52 through a power shaft 54. The propeller 52 and a substantial part of the power shaft 54 are located beneath the surface 26 of the body of water 28. The outboard engine 40 also includes conventional fuel and steering systems which are respectively used to provide the outboard engine 40 with fuel from an external tank (not shown) and to change the thrust angle of the propeller 52 relative to the longitudinal axis 32, so that the dinghy 20 can be steered.

Of course, it will be well understood by those skilled in the art that the outboard engine 40 could have an integral fuel tank or that the outboard engine 40 could be replaced by a conventional battery-powered electric trolling motor without need to change the basic configuration of the engine mount 42. The outboard engine 40 is best stored with its power shaft 54 vertical, as if in normal operating position, or with the power shaft 54 within about 30 degrees from horizontal (i.e., substantially horizontal), with the propeller 52 pointed upward.

To remove the Outboard engine 40 from the transom 34 for storage away from the dinghy 20, it is necessary for a person standing in the dinghy 20 to release the clamps 46 so that the outboard engine 40 can be removed from the transom 34. Removal generally involves the person in the dinghy 20 standing up in the dinghy 20 to lift the engine 40 over the transom 34 and into the hull 22 of the dinghy 20. From there, after grasping the engine 40 in a more secure manner, the person in the dinghy 20 then must offload the engine 40 over the water 28 to the mother boat. Clearly, in both of the lifting actions just described, the person in the dinghy 20 is prone to lifting injuries and/or at high risk of dropping the engine 40 into the water 28. Further, removal of the engine 40 for storage aboard the mother boat is best carried out with at least one additional person in place aboard the mother boat.

Figure 2:
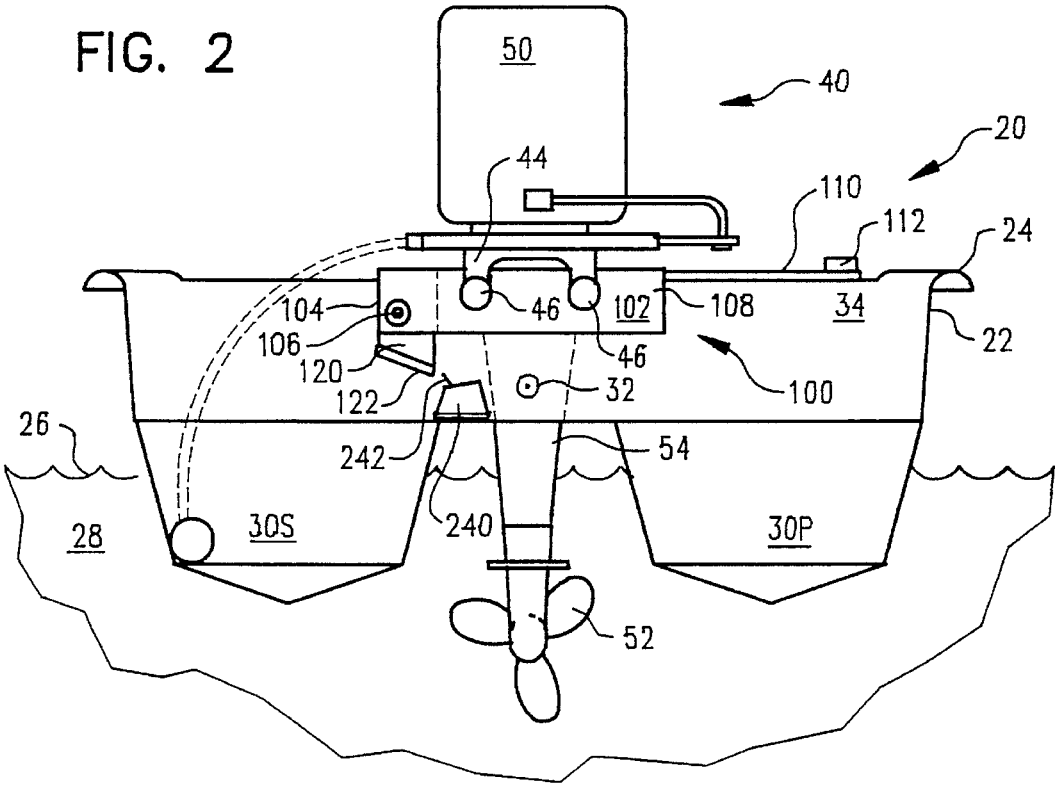
FIG. 2 is an aftward transverse cross-section view of a dinghy with an engine installed with an apparatus of and for use with a method of the present invention, showing the engine in an operating position.

FIG. 2 is an aftward transverse cross-section view of a dinghy with an engine installed with an apparatus of and for use with a method of the present invention, showing the engine in an operating position. Where features shown in the figures describing the invention are unchanged from those shown in the prior art shown in FIG. 1, those features are given the same reference numeral. The outboard engine 40 is connected to the dinghy 20 by means of the apparatus 100 of the present invention. The apparatus 100 includes a bracket 102 having parts that are generally made from stainless steel (typically 10 or 12 gage sheet, although other forms, such as tube and rod are needed as well). The parts could be made from other suitable materials.

The bracket 102 is pivoted at one end 104 by a first pivot 106. The first pivot 106 is substantially horizontal (i.e., within 30 degrees of horizontal). The other end 108 of the bracket 102 serves as an attachment point for a lifting arm 110. The end of the lifting arm 110 includes a handle 112. When the engine 40 is in its operating position, the lifting arm 110 of the bracket 102 is aligned with the upper edge of the transom 34.

A person standing in the hull 22 can easily lift the handle 112 of the lifting arm 110. This allows the bracket 102 to pivot about the first pivot 106, rotating the bracket 102 in the plane of the transom 34. Placing the handle 112 at the end of a large lever arm affords a great mechanical advantage to the individual stowing the engine 40 and allows the engine to be lifted clear of the gunwale 24 of the hull 22 without requiring the center of gravity of the engine 40 to be lifted any more than the minimum necessary. The mounting bracket 44 of the engine 40 is fixedly attached to the bracket 102 by means of bolts which are fastened through matching holes on the after sides of the brackets 44 and 102, as will be described subsequently. The bracket 102 is U-shaped to fit in close conformity with the transom 34, which may be protected from undue wear by a scuff plate (not shown) that is encompassed by the bracket 102 when the engine 40 is in its operating position. The bracket 102 is preferably made from a springy metal material and its fore-and-aft cross-section has a downward-flaring wedge shape that is somewhat compressed when the clamps 46 are tightened against the bracket 102. This allows a snug fit between the bracket 102 and the underlying transom 34 (or its scuff plate), so that the clamps 46 can be used to position the bracket 102 relative to the transom 34 when the engine 40 is in its operating position.

The first pivot 106 at the first end 104 of the bracket 102 is attached to a transfer plate 120 having a bottom edge that defines a second pivot 122. The second pivot 122 is also substantially horizontal (i.e., within about 30 degrees of horizontal), as will be described subsequently.

Figure 3:
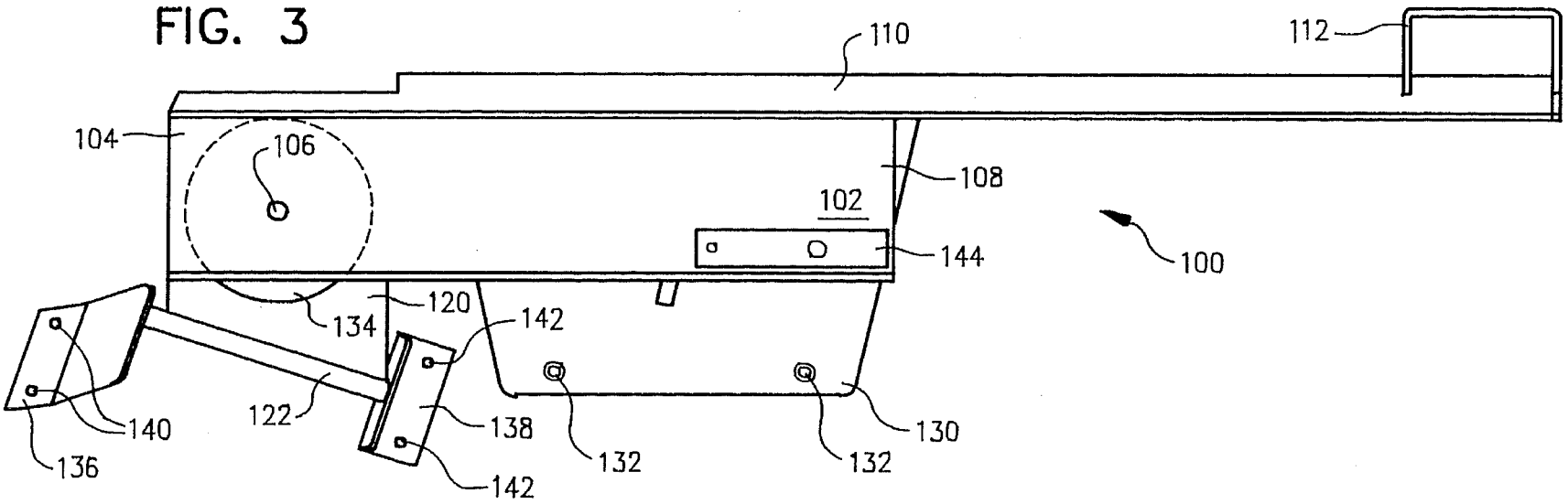
FIG. 3 is an elevation view of the bracket of the preferred embodiment of the invention.

FIG. 3 is an elevation view of the bracket of the preferred embodiment of the invention. The bracket 102 includes the mounting plate 130 which extends aftward and downward from the lifting arm 110. The mounting bracket 44 of the engine 40 or a motor that is used with the preferred embodiment of the present invention is bolted to the mounting plate 130 through standard fasteners inserted through the holes 132. The pattern of the holes 132 can be changed to accommodate any expected variety of engines or motors, and additional holes 132 can be formed in the mounting plate 130 to fit any unanticipated engine or motor. As described above, when it is used in the operating position with an engine 40 in place, the mounting plate 130 fits snugly over the transom 34 or over a scuff plate (not shown) that is placed over the transom 34 to reduce friction and wear on the transom 34. The actual fit between the mounting plate 130 and the transom 34 or scuff plate can be controlled by adjusting the clamps 46.

The space between the first end 104 and the transfer plate 120 is occupied by a circular brass washer 134, which reduces the friction between the first end 104 and the transfer plate 120.

The second pivot 122 is held in fixed position relative to the hull 22 by means of two pivot brackets 136 and 138, which are fastened to the transom 34 by means of fasteners through the respective holes 140 and 142. The pivot brackets 136 and 138 can be made from sheet stainless steel. A stainless steel pin (not shown) is welded to each of the pivot brackets 136 and 138 and passes through a tube that forms the second pivot 122 so that the transfer plate 120 can rotate relative to the pivot brackets 136 and 138. Accordingly, the bracket 102 is U-shaped in the fore-and-aft direction to fit in close conformity with the transom 34. The bracket 102 is made from a springy metal material, so that it is flexible, and the bracket 102 flares downward. The mounting bracket 44 of the engine 40 is bolted to the mounting plate 130 of the bracket 102 by fasteners through the holes 132. The downward-flaring wedge shape of the fore-and-aft cross-section of the bracket 102 is somewhat compressed when the clamps 46 of the engine 40 are tightened against the bracket 102, allowing a snug fit between the bracket 102 (which is shaped by the mounting bracket 44 and the clamps 46 of the engine 40) and the underlying transom 34 (or its scuff plate).

The first pivot 106 at the first end 104 of the bracket 102 is attached to a transfer plate 120, whose second pivot 122 is held in fixed position relative to the hull 22 by the two pivot bracket 136 and 138, which are fastened to the transom by fasteners through the holes 140 and 142.

The bracket 102 also includes a locking mechanism 144, which is placed at the second end 108 of the bracket 102. As will be described subsequently, the locking mechanism 144 is a spring-loaded handle having a pin that locks the bracket 102 against the transom 34 or a scuff plate by passing through a hole in the second end 108 of the bracket 102 and then through a matching hole in the transom 34 or the scuff plate.

Figure 4A:
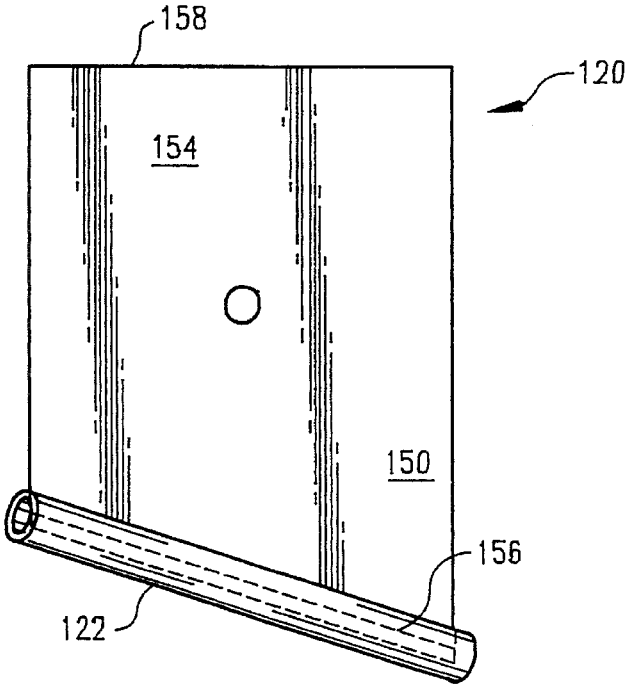
FIG. 4A is a first elevation view of a transfer plate in the bracket of the preferred embodiment of the invention.
Figure 4B:
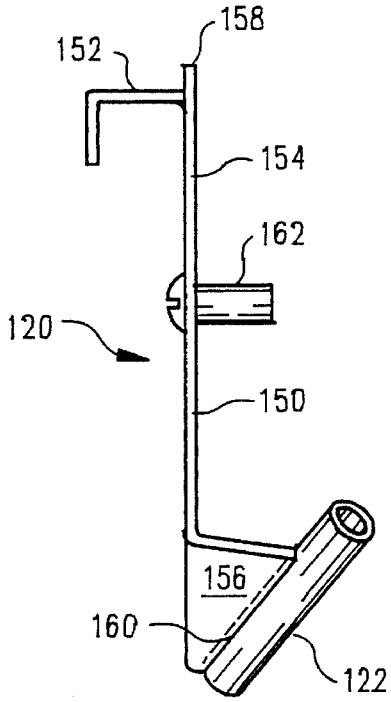
FIG. 4B is a second elevation view of the transfer plate in the bracket of the preferred embodiment of the invention, the view of FIG. 4B being perpendicular to the view of FIG. 4A.
Figure 4C:
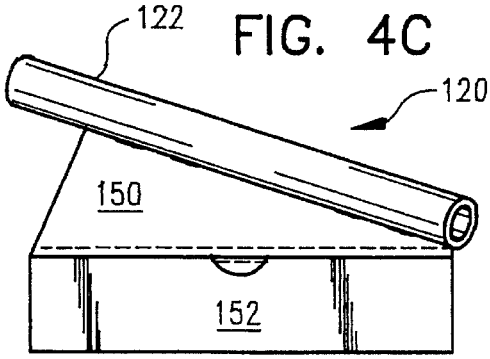
FIG. 4C is a bottom view of the transfer plate in the bracket of the preferred embodiment of the invention.

FIG. 4A is a first elevation view of a transfer plate in the bracket of the preferred embodiment of the invention. FIG. 4B is a second elevation view of the transfer plate in the bracket of the preferred embodiment of the invention, the view of FIG. 4B being perpendicular to the view of FIG. 4A, and FIG. 4C is a bottom view of the transfer plate in the bracket of the preferred embodiment of the invention. The transfer plate 120 includes the second pivot 122, a flange 150, and a transom bracket 152. The second pivot 122 is made from a length of stainless steel tube that has a 0.375 inch inner diameter. The flange 150 is made from a bent piece of 10 gage stainless steel sheet. The transom bracket 152 is made from a bent piece of 12 gage stainless steel sheet.

The bend in the flange 150 is ninety degrees and separates the flange 150 into an upper planar portion 154 and a lower planar portion 156. The lower planar portion 156 is at an angle of approximately 17 degrees with respect to an upper edge 158 of the upper planar portion 154. The lower planar portion 156 is shaped triangularly and its outer edge 160 forms an angle of approximately 18 degrees with respect to the plane of the upper planar portion 154. Accordingly, the axis of the second pivot 122 is approximately (i.e., within 30 degrees of) horizontal when the hull 22 is floating in the water. The angle between the upper planar portion 154 and the upper edge 158 and the angle between the outer edge 160 and the upper planar portion 154 can be adjusted to fit various engines, motors and dinghies, as long as the axis of the second pivot 122 is approximately horizontal. The tube that forms the second pivot 122 is welded to the outer edge 160 of the lower planar portion 156. A pin (not shown), having an outer diameter no greater than 0.375 inch, passes through the tube of the second pivot 122, and each end thereof is respectively welded to one of the pivot brackets 136 and 138.

The transom bracket 152 is welded near the upper edge 158 and perpendicular to the plane of the upper planar portion 154 of the flange 150. It is welded to the side of the upper planar portion 154 that is opposite the side of the upper planar portion 154 from which the lower planar portion 156 is bent. The first pivot 106 is formed from a stainless steel machine screw 162 whose threads are directed outwardly from the transom 34, through a hole in the upper planar portion 154 of the flange 150 and a hole in the circular brass washer 134, to a hole in the first end 104 of the bracket 102.

Figure 5B:
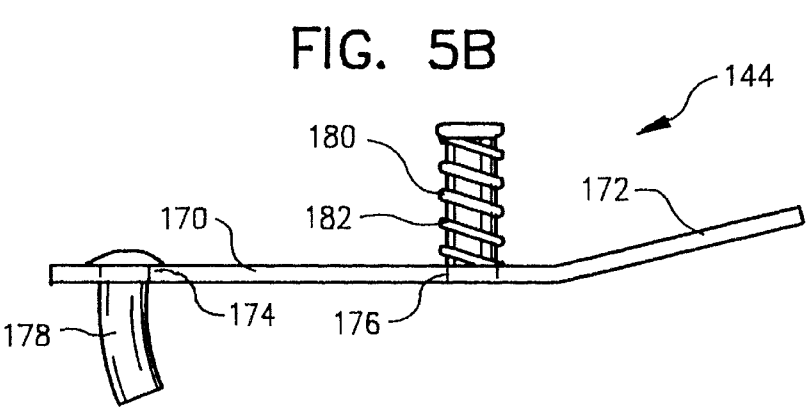
FIG. 5B is a bottom view of the locking mechanism in the bracket of the preferred embodiment of the invention.
Figure 5A:
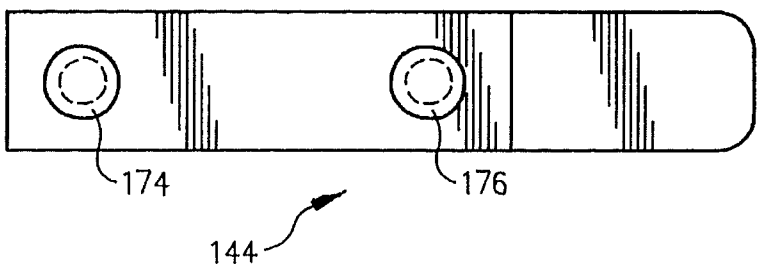
FIG. 5A is an elevation view of a locking mechanism in the bracket of the preferred embodiment of the invention.

FIG. 5A is an elevation view of a locking mechanism in the bracket of the preferred embodiment of the invention, and FIG. 5B is a bottom view of the locking mechanism in the bracket of the preferred embodiment of the invention. The locking mechanism 144 is made from a bent piece of 12 gage stainless steel sheet that is divided into a longer portion 170 and a shorter portion 172 by the bend. The portions 170 and 172 are at a 150 degree angle relative to one another. The longer portion 170 has two holes 174 and 176 formed therein. The hole 174, which is the further removed from the bend between the portions 170 and 172 and has a diameter of 0.25 inch, also has a 0.25 inch clevis pin 178 inserted therein and welded in place, after the clevis pin 178 has been bent to a radius of 2 inches. The bent clevis pin 178 extends away from the longer portion 170 in the direction opposite the direction that the shorter portion 172 bends away from the longer portion 170. The hole 176 has a diameter greater than 0.25 inch (say, 17/64 inch) and a 0.25 inch diameter clevis pin 180 having a coil spring 182 captured thereon is inserted through the hole 176 and welded to the forward portion of the second end 108 of the bracket 102.

The locking mechanism 144 is activated by pressing downward on the shorter portion 172, causing the bend between the two portions 170 and 172 to be forced against the bracket 102. The bend between the two portions 170 and 172 serves as a fulcrum and causes the longer portion 170 to move away from the bracket 102 in a rotating motion centered on the bend. This action causes the clevis pin 178 to withdraw from the matching holes in the second end 108 of the bracket 102 and in the transom 34 or the scuff plate, so that the bracket 102 is then unlocked from the transom 34 or the scuff plate. The coil spring 182 biases the clevis pin 178 toward the bracket 102, so that the locking mechanism 144 stays locked until it is desired to release it.

Figure 6:
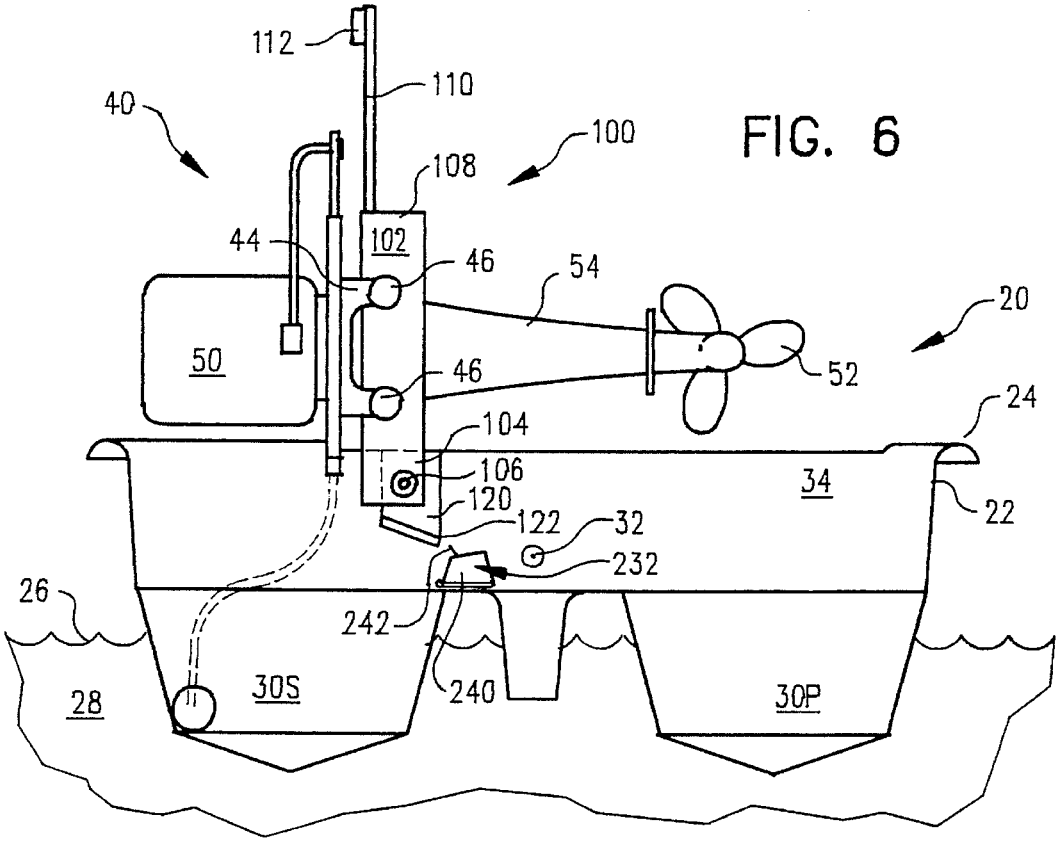
FIG. 6 is an aftward transverse cross-section view of a dinghy with an engine being stowed from an operating position, in accordance with a first step of a method of the present invention.
Figure 7:
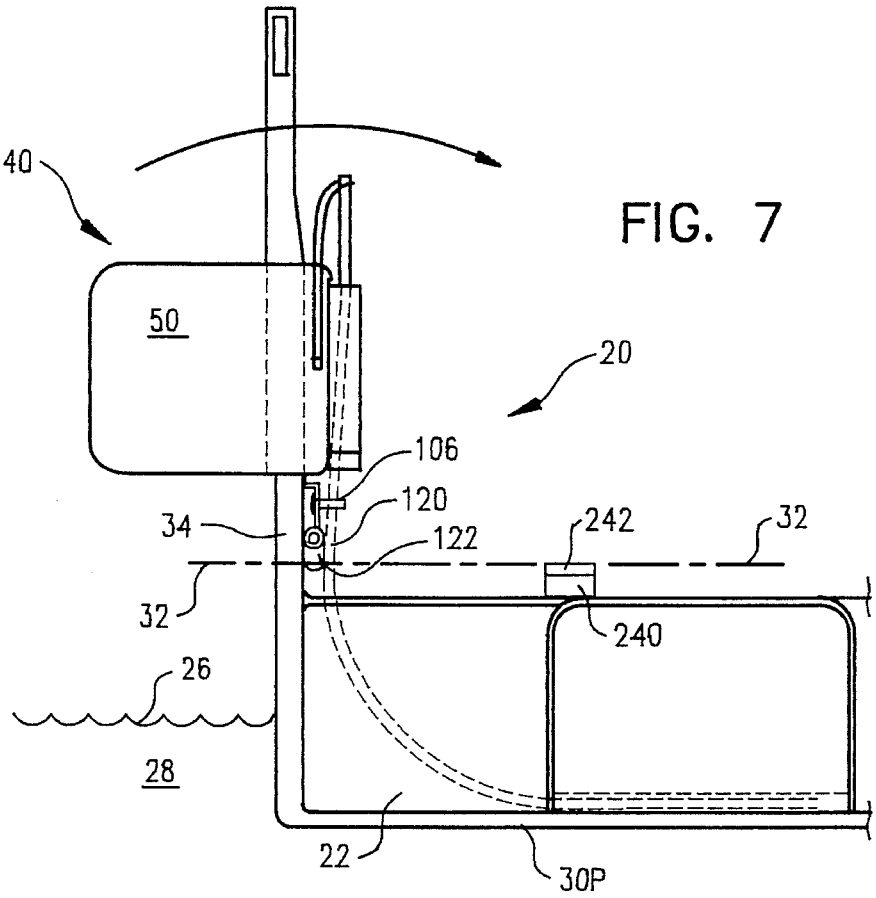
FIG. 7 is a portward longitudinal cross-section view of a dinghy with an engine being stowed from an operating position, in accordance with the first step of the method of the present invention, as also shown in FIG. 6.

FIG. 6 is an aftward transverse cross-section view of a dinghy with an engine being stowed from an operating position, in accordance with a first step of a method of the present invention, and FIG. 7 is a portward longitudinal cross-section view of a dinghy with an engine being stowed from an operating position, in accordance with a first step of the method of the present invention. As shown in FIGS. 6 and 7, when the lifting arm 110 has been raised through approximately 90 degrees (within 10 degrees), the power shaft 54 of the engine 40 is now substantially horizontal and clear of the transom 34. The bracket 102 can then be rotated forward about the second pivot 122, bringing portions of the engine 40 that were previously outboard of the hull 20 within the horizontal plan of the hull 20. Simultaneously, portions of the engine 40 that were previously above the plane defined by the gunwale 24 are brought below that plane. This consequently lowers the center of gravity of the dinghy-engine combination and makes it more stable.

Figure 8:
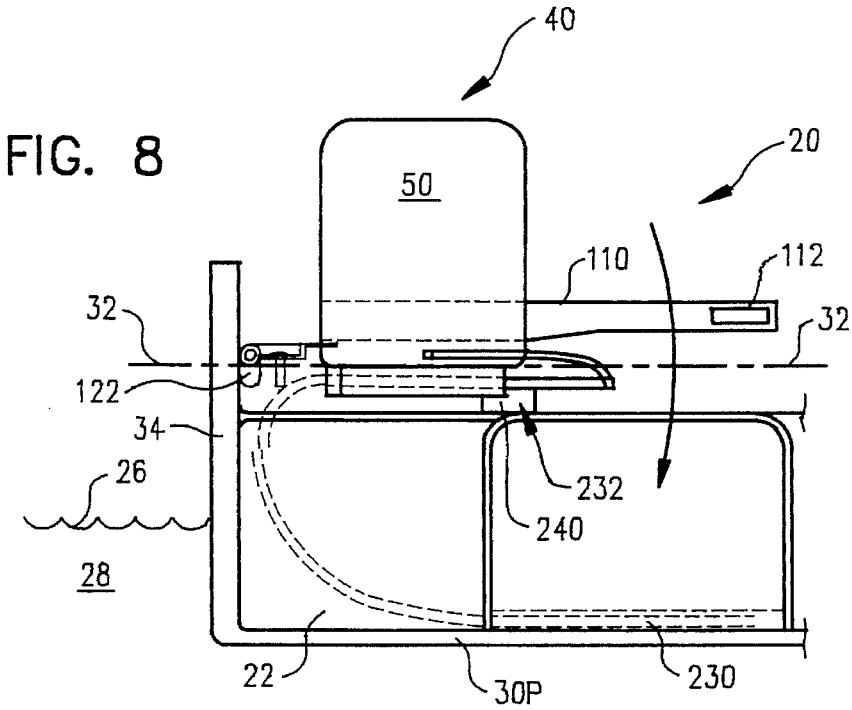
FIG. 8 is a portward longitudinal cross-section view of a dinghy with an engine being stowed from an operating position, in accordance with a second step of a method of the present invention.

FIG. 8 is a portward longitudinal cross-section view of a dinghy with an engine being stowed from an operating position, in accordance with a second step of a method of the present invention. In this view, the lifting arm 110 is lowered forward from its position in FIGS. 6 and 7, to a substantially horizontal position. If desired, the lifting handle 110 can be caused to mate with a keeper 232 that is removably attached to a surface 230 inside the hull 22 of the dinghy 20. When not in use, the keeper 232 can be removed and stored out of the way (say, against the transom 34). The locking mechanism 144 of the bracket 102 engages a hole 234 formed in an extending flange 242 of the keeper 232 in such a way that the bracket 102 is locked in the stowed position by the clevis pin 178 being biased through the hole 234 by the spring 182. While the keeper 232 provides a sure mechanical lock against the lifting arm 110 moving upwardly away from the surface 230 of the dinghy 20, security concerns may make it desirable to also padlock the lifting arm 110 to the surface 230. This can be accomplished by adaptation of the keeper 232 in accordance with techniques known to those skilled in the art of mechanical design.

In the sequence of operations represented by FIGS. 2, 6, 7 and 8, it has not been necessary to detach any cables or fuel lines that lead from engine controls or fuel tanks that are located within the hull 22. This fact can be particularly advantageous to the present invention since it obviates many of the extra steps that are usually associated with stowage of a dinghy engine.

Figure 9:
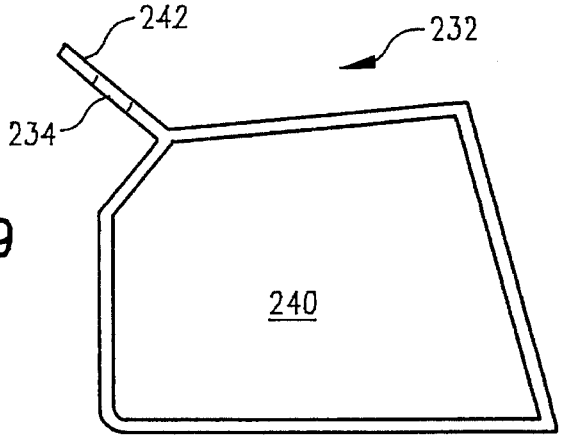
FIG. 9 is an elevation view of a keeper that is used in connection with the preferred embodiment of the apparatus of the present invention.

FIG. 9 is an elevation view of a keeper that is used in connection with the preferred embodiment of the apparatus of the present invention. The keeper 232 is formed by welding together two bent pieces of 12 gage stainless steel sheet to form a box 240 with the extending flange 242 through which the hole 234 passes. The keeper 232 is then attached to the surface 230 in any conventional manner, such as that described above. The angle of the extending flange 242 relative to the surface 230 is chosen so that the locking mechanism 144 will be properly aligned to engage the hole 234 while holding the bracket 102 in a stowed position such that the engine 40 or motor attached to the bracket 102 is held away from the surfaces 230 of the dinghy 20, but in an acceptable storage attitude within the concave hull 22. Further, the engine 40 or motor is then supported only by structures that are attached to the dinghy 20.

Figure 10:
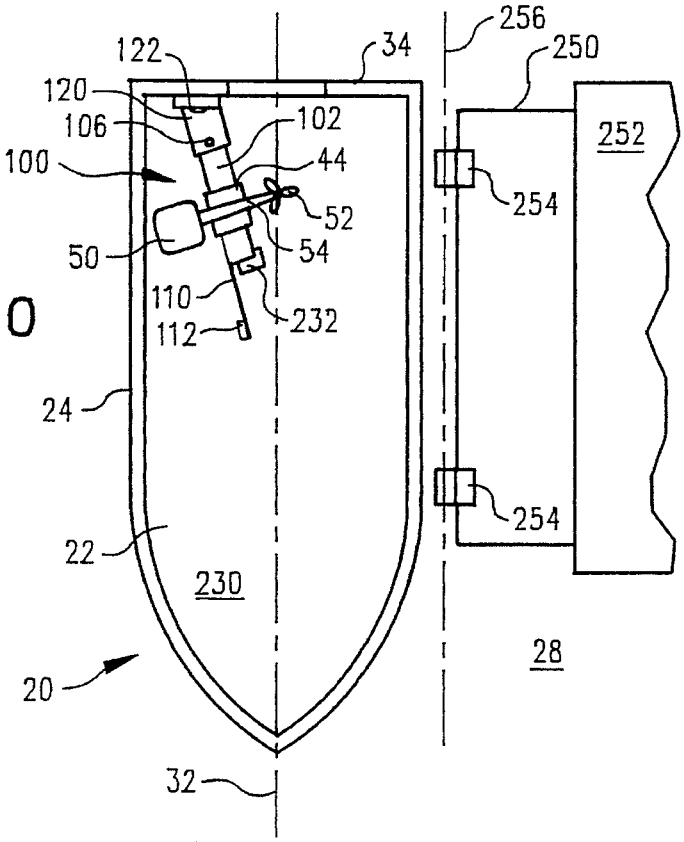
FIG. 10 is a schematic diagram of an additional aspect of the method of the invention, showing the stowing of a first boat against a second boat.

FIG. 10 is a schematic diagram of an additional aspect of the method of the invention, showing the stowing of a first boat against a second boat. The first boat can be the dinghy 20 which is attached to a portion 250 of a second boat 252 by means of a davit system. The portion 250 of the second boat 252 can be a swim platform, for example. Such a davit system typically consists of two or more davits 254 which are permanently attached to the portion 250 of the second boat 252 and which can be temporarily attached to the gunwale 24 of the dinghy 20. After the engine 40 or motor is moved from its operative position to a stowed position within the concave hull 22 of the dinghy 20, the dinghy 20 is swung upward, about the axis 256 that is formed by the two davits 254, until the dinghy 20 is out of the water 28 and located on the portion 250. The dinghy 20 is then attached to the second boat 252 in accordance with good dinghy stowage practices known to mariners and described in "Piloting, Seamanship, and Small Boat Handling," by Chapman. This series of operations will leave the engine 40 or motor enclosed within the concave hull 22 of the stowed dinghy 20, against the second boat 252, and in a vertical orientation appropriate for engine or motor stowage.

Figure 11:
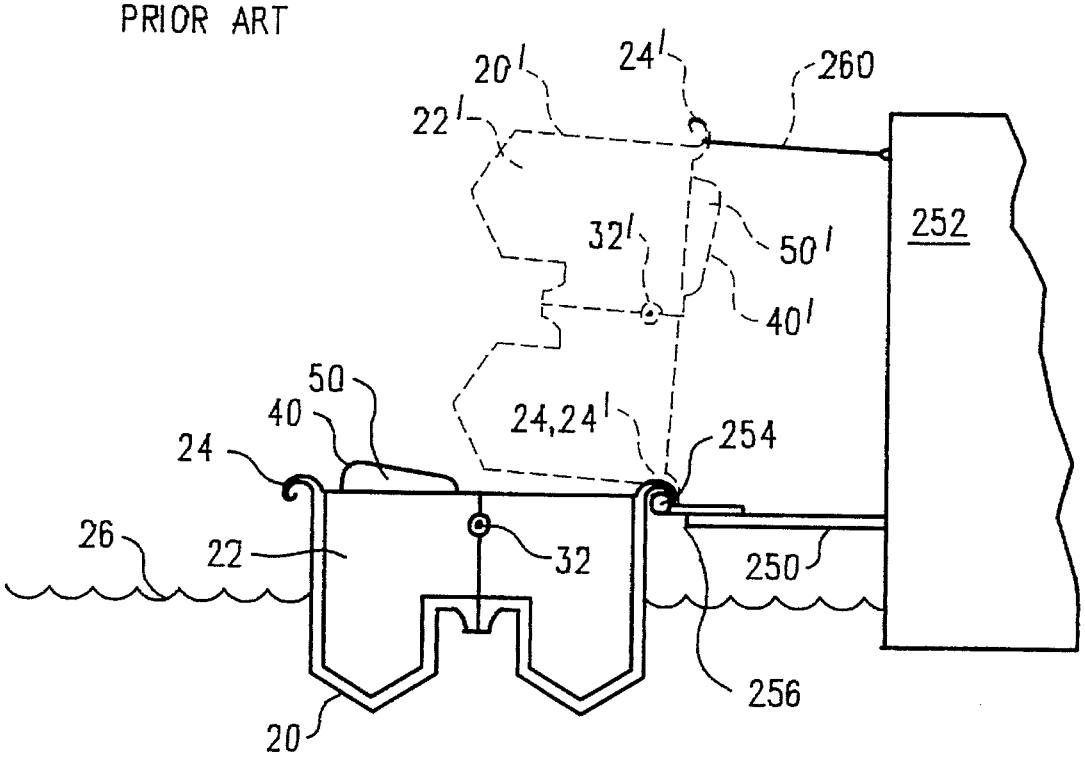
FIG. 11 PRIOR ART
FIG. 11 is a cross sectional drawing of the operation of stowing a first boat against a second boat, as known in the prior art, and also showing a portion of the additional aspect of the method of the invention shown in FIG. 10.

FIG. 11 is a cross sectional drawing of the operation of stowing a first boat against a second boat, as known in the prior art, and also showing a portion of the additional aspect of the method of the invention shown in FIG. 10. FIG. 11 shows the dinghy 20 (including the hull 22 having the longitudinal axis 32) with its gunwale 24 attached to the portion 250 of the second boat 252. The dinghy 20 is initially floating on the water 26. The two davits 254 define the axis 256. As shown in the top view of FIG. 10, the portion of the prior art method that is also part of an aspect of the present invention includes the stowage of the power unit 50 of the engine 40 prior to folding the first boat (the dinghy 20) against the second boat 252. FIG. 11 also shows a ghost view of the dinghy 20' (with hull 22', gunwale 24', and longitudinal axis 32') carrying the stowed engine 40' having the power unit 50', with the dinghy 20 folded against the second boat 252 and held in position by the link 260, as is known in the prior art. It is also known in the prior art that the link 260 (which may take the form of a line) can be used to move the dinghy 20 between floating in the water 26 and being folded against the second boat 252.

While the foregoing has provided a complete detailed description of the preferred embodiment of the invention, those skilled in the art of mechanical design will be able to design other embodiments that are not described here, yet are within the scope of the present invention. As one simple example, a mirror image embodiment of the present invention would be within the skill of those skilled in the art of mechanical design. Further, it will be apparent to make other uses of the invention, such as stowing an anchor from overboard and retrieving outboard fishing gear. Also, the method and apparatus of the present invention can be used to unstow a stowed engine 40 or motor from a dinghy 20. Accordingly, the present invention is to be limited only by the following claims.

I claim:

1. A method for stowing an outboard propulsion device in a concave boat hull floating in water and having a substantially horizontal longitudinal axis, the outboard propulsion device being fixedly mounted on a motor mount along the longitudinal axis of the boat hull so that the outboard propulsion device has a first portion that is in the water outboard of the hull when the outboard propulsion device is in a deployed position, the motor mount having a first substantially horizontal axis and a second substantially horizontal axis that is substantially perpendicular to the first axis, the first axis being parallel to but separate from the longitudinal axis and the second axis being fixed relative to the hull, the method comprising the steps of:

a) rotating the motor mount about the first axis until the motor mount is above the hull; and b) rotating the motor mount about the second axis and into the hull so that the first portion of the outboard propulsion device is stowed within the hull in a stowed position.

2. The method of claim 1, wherein the method further comprises the step of:

c) unlocking the motor mount from the deployed position before performing step a).

3. The method of claim 1, wherein the method further comprises the step of:

c) locking the motor mount in the stowed position.

4. The method of claim 1, wherein the outboard propulsion device is an electric motor.

5. The method of claim 1, wherein the outboard propulsion device is a fuel-powered engine.

6. The method of claim 1, wherein the outboard propulsion device is remotely steerable from within the hull via steering means attached to the outboard propulsion device and steps a) and b) are performed without detaching the steering means from the outboard propulsion device.

7. An apparatus for stowing an outboard propulsion device in a concave boat hull floating in water and having a substantially horizontal longitudinal axis, the outboard propulsion device being fixedly mounted on a motor mount along the longitudinal axis of the boat hull so that the outboard propulsion device has a first portion that is in the water outboard of the hull when the outboard propulsion device is in a deployed position, the motor mount having a substantially horizontal first axis and a substantially horizontal second axis that is substantially perpendicular to the first axis, the first substantially horizontal axis being parallel to but separate from the longitudinal axis and the second axis being fixed relative to the hull, the apparatus comprising:

a first pivot to rotate the motor mount about the first axis until the motor mount is above the hull; and a second pivot to rotate the motor mount about the second axis and into the hull so that the first portion of the outboard propulsion device is stowed within the hull in a stowed position.

8. The apparatus of claim 7, further comprising:

means for unlocking the motor mount from the deployed position.

9. The apparatus of claim 7, further comprising:

means for locking the motor mount in the stowed position.

10. The apparatus of claim 7, wherein the outboard propulsion device is an electric motor.

11. The apparatus of claim 7, wherein the outboard propulsion device is a fuel-powered engine.

12. The apparatus of claim 7, further comprising one or more fasteners to fixedly mount the outboard propulsion device on the motor mount.

13. The apparatus of claim 7, further comprising a flexible bracket to which the outboard propulsion device is fixedly mounted, the bracket having a force fit between the outboard propulsion device and the hull when the motor mount is in the deployed position.

14. An apparatus for stowing an outboard propulsion device in a concave boat hull floating in water and having a substantially horizontal longitudinal axis, the outboard propulsion device being fixedly mounted on a motor mount along the longitudinal axis of the boat hull so that the outboard propulsion device has a first portion that is in the water outboard of the hull when the outboard propulsion device is in a deployed position, the motor mount having a substantially horizontal first axis and a substantially horizontal second axis that is substantially perpendicular to the first axis, the first substantially horizontal axis being parallel to but separate from the longitudinal axis and the second axis being fixed relative to the hull, the apparatus comprising:

first pivot means for rotating the motor mount about the first axis until the motor mount is above the hull; and second pivot means for rotating the motor mount about the second axis and into the hull so that the first portion of the outboard propulsion device is stowed within the hull in a stowed position.

* * * * *